US005232000A

United States Patent [19]

Chiavaras et al.

[11] Patent Number: 5,232,000

[45] Date of Patent: Aug. 3, 1993

[54] METHOD OF CUTTING HAIR

[75] Inventors: Charles G. Chiavaras; Ronald J. Neimkin; Deborah P. Neimkin, all of Asheville, N.C.

[73] Assignee: Ergonomic Tool Associates, Asheville, N.C.

[21] Appl. No.: 917,600

[22] Filed: Jul. 20, 1992

Related U.S. Application Data

[62] Division of Ser. No. 774,994, Oct. 11, 1991, Pat. No. 5,153,997.

[51] Int. Cl.[5] ..... A45D 24/00

[52] U.S. Cl. ..... 132/200; 83/13

[58] Field of Search ..... 132/200, 207, 212, 214; 30/248, 257; 83/13, 915

[56] References Cited

U.S. PATENT DOCUMENTS

| | | | |
|---|---|---|---|
| D. 310,714 | 9/1990 | Dolwick . | |
| 590,330 | 9/1897 | Nolen . | |
| 673,043 | 4/1901 | Burner . | |
| 733,919 | 7/1903 | Schwartz . | |
| 833,714 | 10/1906 | Goode . | |
| 881,890 | 3/1908 | Barr . | |
| 968,219 | 8/1910 | Wheeler . | |
| 1,042,240 | 10/1912 | Lillick . | |
| 1,330,515 | 2/1920 | Bryant | 30/257 |
| 2,136,414 | 11/1938 | Clements | 30/248 |
| 2,624,114 | 1/1953 | Althausen | 30/257 |
| 3,066,412 | 12/1962 | Melton | 30/257 |
| 3,175,291 | 3/1965 | Nardo | 30/257 |
| 3,825,020 | 7/1974 | Myers | 132/200 |
| 4,146,961 | 4/1979 | Pinto | 30/341 |
| 4,254,551 | 3/1981 | Megna . | |
| 4,315,369 | 2/1982 | Borow . | |
| 4,345,378 | 8/1982 | Pracht | 30/266 |
| 4,642,895 | 2/1987 | Gauvry | 30/341 |

*Primary Examiner*—John G. Weiss

*Attorney, Agent, or Firm*—Carter and Schnedler

[57] ABSTRACT

There is provided a method for a user to cut hair utilizing a scissors having first and second beams, each of which having a shearing edge and a handle and including a pivot fulcrum affixing the first and second beams together and permitting the beams to rotate with respect to one another with the pivot located between the shearing edge and the handle of each beam. Each handle includes a first and second portions with the first portion located nearer to the pivot than the second portion. The second portion includes a first and second loops. The loops are on a different plane from the first portion. The method includes placing a first digit of the hand of the user through the first loop and placing a second digit through the second loop, cutting hair on one side of the head, placing the first digit through the second loop and placing the second digit through the first loop and then cutting the other side of the head.

5 Claims, 4 Drawing Sheets

METHOD OF CUTTING HAIR

This is a divisional of copending application Ser. No. 07/774,994 filed on Oct. 11, 1991 now U.S. Pat. No. 5,153,997.

BACKGROUND OF THE INVENTION

This invention relates to cutting apparatus. More particularly, it relates to scissors for use by hair designers, barbers and other hair stylists for cutting hair.

Typical scissors which are currently widely used to cut and trim hair is shown in FIG. 1. A pair of beams 10 and 12 are rotatably attached to one another by screw 14, which forms a pivot point. The beams include handles 16 and 18 each having loops for securing one's digits thereto. The beams also include a pair of cutting edges 20 and 22 which cut the hair by the closure of the beams. The cutting edges and handles are in the same plane of rotation, i.e. the beams are straight.

During the course of cutting and trimming hair using prior art straight scissors, the stylist must assume various positions which may result in cumulative physical trauma requiring specialized medical treatment. In order to cut the hair using straight scissors, the stylist must position his or her wrist both in extreme dorsiflexion as well as palmarflexion. An example of extreme palmarflexion by a hair stylist is shown in FIG. 2. These positions of the wrist when done repetitively often result in various traumas including carpal tunnel syndrome (median nerve compression at the wrist), tenosynovitis (inflammation of flexor or extensor tendons) and lateral epicondylitis (tennis elbow). Furthermore, by using the straight scissors, the stylist often must raise the elbow 13 to an uncomfortable position and abduct the shoulder 15 to approximately 90° which will increase the chances of tendonitis or bursitis of the shoulder and further increases the incidence of thoracic outlet syndrome (brachial plexus compression by the neck muscles and the first rib). There is a higher incidence of this syndrome in females due to their neck anatomy and the size of their breasts.

In addition to medical problems, the stylist will normally cut opposing sides of the head in the opposite directions resulting in an uneven flow of the hair which may alter the appearance of the hair design. In addition, the use of the straight scissors requires the client to change position of the head very often during the cut.

It is therefore desirable to provide a new design of scissors which overcomes the problems of the prior art straight scissors.

OBJECTS OF THE INVENTION

It is therefore one object of this invention to provide ergonomically designed scissors.

It is another object to provide scissors for cutting hair which reduces the probability that the user will suffer cumulative physical strain and trauma.

It is another object to provide ergonomically designed scissors for use by a hair stylist which enables a higher quality haircut.

It is still another object of the invention to provide ergonomic scissors which are not substantially more expensive to produce than conventional scissors and which are easier to use.

SUMMARY OF THE INVENTION

In accordance with one form of this invention there is provided a scissors for cutting hair which includes first and second beams. Each of the beams has a shearing edge and a handle. A pivot mechanism is provided between the shearing edge and the handle of each beam. The pivot mechanism also affixes the first and second beams together and permits the beams to rotate with respect to one another. Each handle includes a first and second portion. The first portion is located nearer to the plant mechanism than the second portion. The second portion includes a means for securing at least one digit thereon. The means for securing is on a different plane from the first portion of the handle. It is preferable that each handle includes a bend which divides the first portion from the second portion at an angle which may be between 60° and 120°. It if further preferred that the shearing edge of each beam is in substantially the same plane as the first portion of the handle.

In accordance with another form of this invention there is provided a method for cutting hair utilizing the above-described scissors. The stylist places two of his or her digits through loops, which may be used to form the means for securing, in one direction. The stylist then cuts the hair on one side of the head. The stylist then places the same digits through the opposite loops in the opposite direction and then cuts the hair on the other side of the head.

By utilizing the above-described scissors, the probability that the stylist will suffer various traumas such as, for example, carpal tunnel syndrome, tenosynovitis, lateral epicondylitis, tendonitis and/or bursitis of the shoulder, neck strain, as well as thoracic outlet syndrome is substantially reduced. Furthermore, the quality of the haircut and the comfort of the client are increased without adding significant cost to manufacturer of the scissors. In addition stylists find these scissors easy to operate and the use thereof will improve their ability to visualize the cut due to improved body position of the stylists.

BRIEF DESCRIPTION OF THE DRAWINGS

The subject matter which is regarded as the invention is set forth in the appended claims. The invention itself however together with further objects and advantages thereof may be better understood by reference to the following description taken in conjunction with the accompanying drawings in which:

DESCRIPTION OF THE PREFERRED EMBODIMENT

Figure 1:
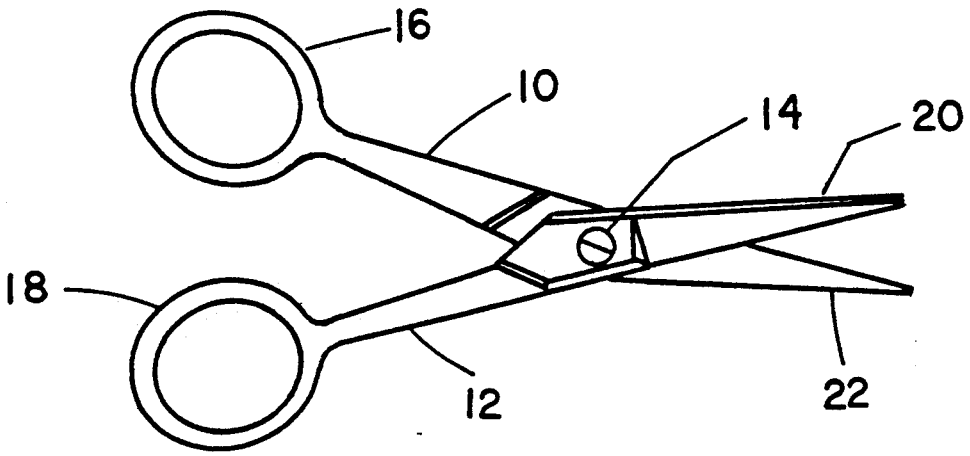
FIG. 1 PRIOR ART
FIG. 1 is a pictorial view of a typical prior art scissors.
Figure 2:
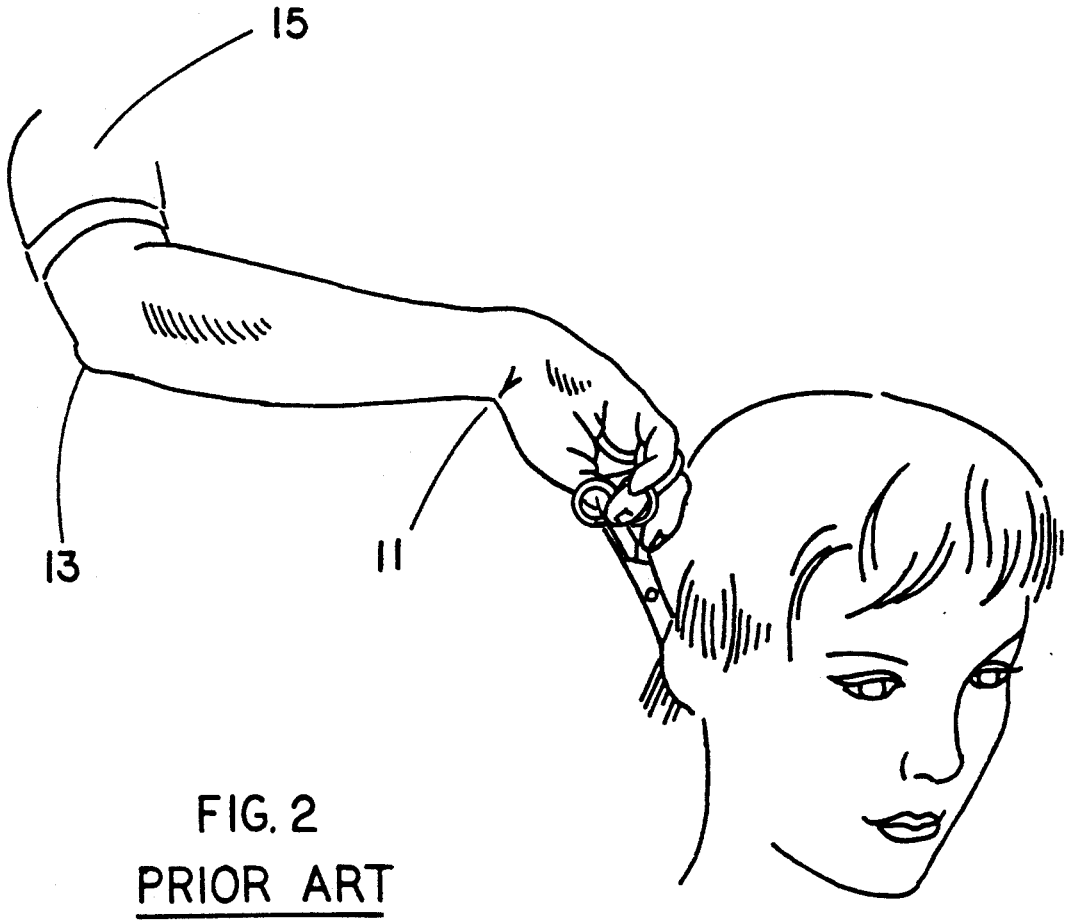
FIG. 2 PRIOR ART
FIG. 2 is a pictorial view of the scissors shown in FIG. 1 in use cutting hair.
Figure 3:
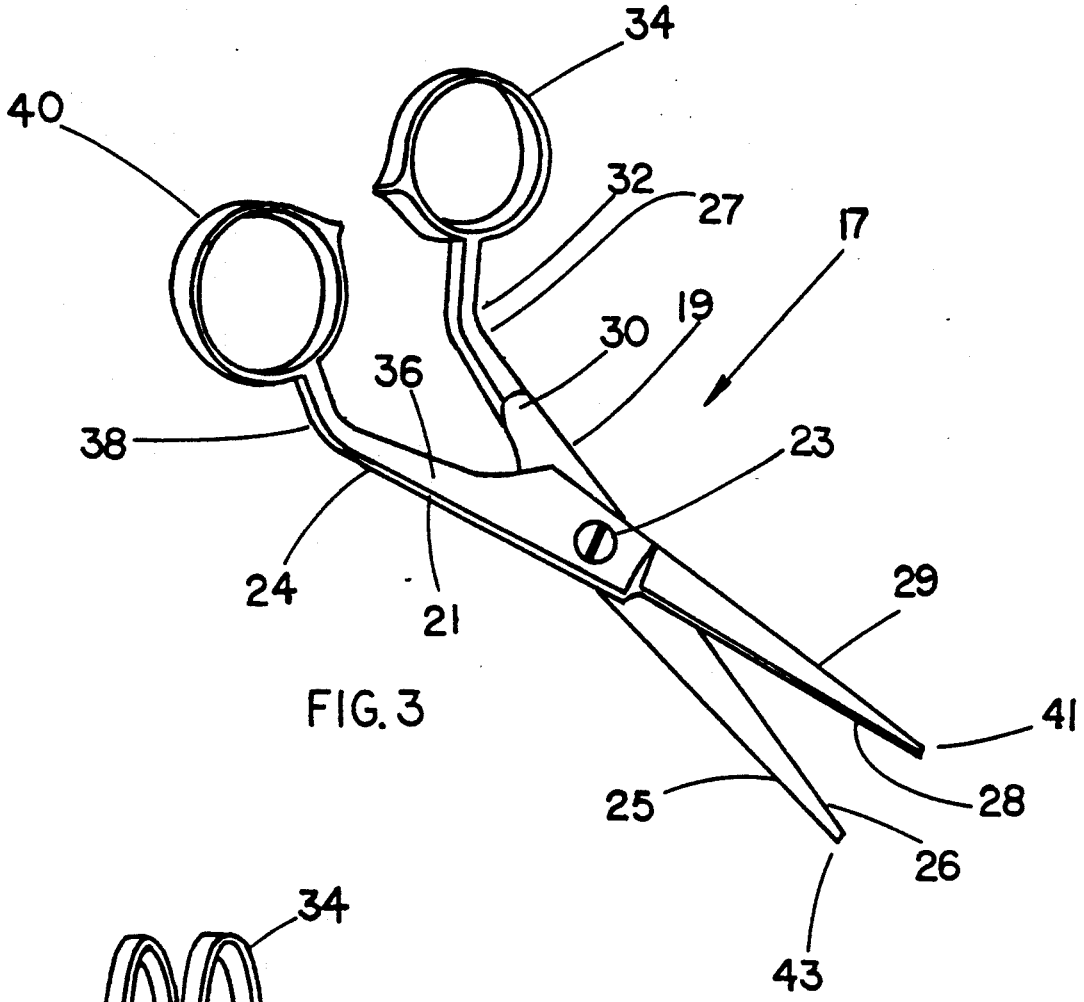
FIG. 3 is a pictorial view of the ergonomic scissors of the subject invention.
Figure 4:
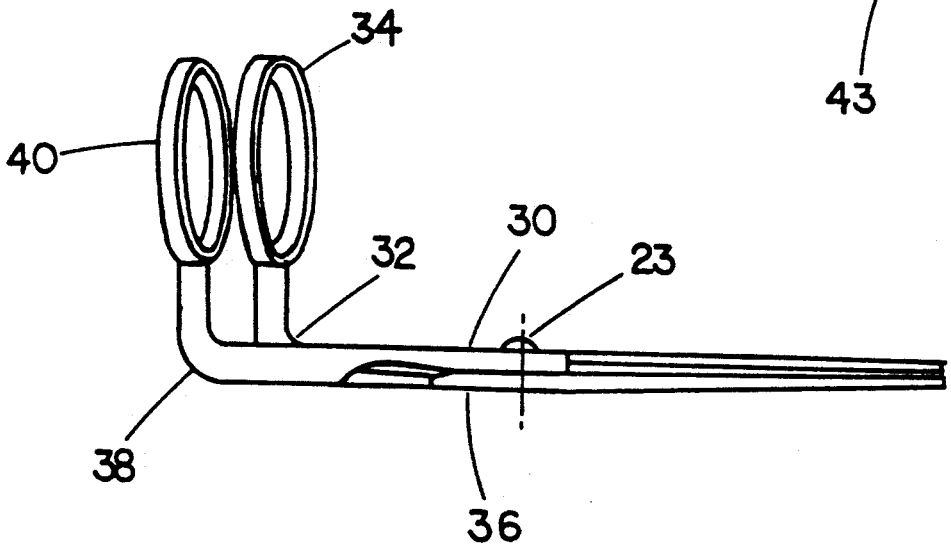
FIG. 4 is a pictorial view showing the ergonomic scissors of FIG. 3 from another angle.

Referring now more particularly to FIGS. 3 through 8, there is provided scissors 17 having beams 19 and 21. Preferably the scissors are made from a high quality steel, cobalt/steel alloy, or ceramic. The beams are swivelably connected together by pivot screw 23 which penetrates through threaded openings in the beams. Screw 23 thus forms a pivot point so that the beams 17 and 19 may rotate with respect to one another.

Beam 19 includes first portion 25 and second portion 27. Beam 21 includes first portion 29 and second portion 24. Portions 25 and 24 include cutting edges 26 and 28, respectively. The cutting edges are sharp and are in close tolerance of one another so that upon closure of the edges hair is easily cut without undue effort by the stylist. Portion 27 of beam 19 includes stabilizing segment 30, bend 32, and a digit receiving eyelet 34. Portion 24 of beam 21 also includes stabilizing segment 36 and bend 38 and digit receiving eyelet 40.

Figure 5:
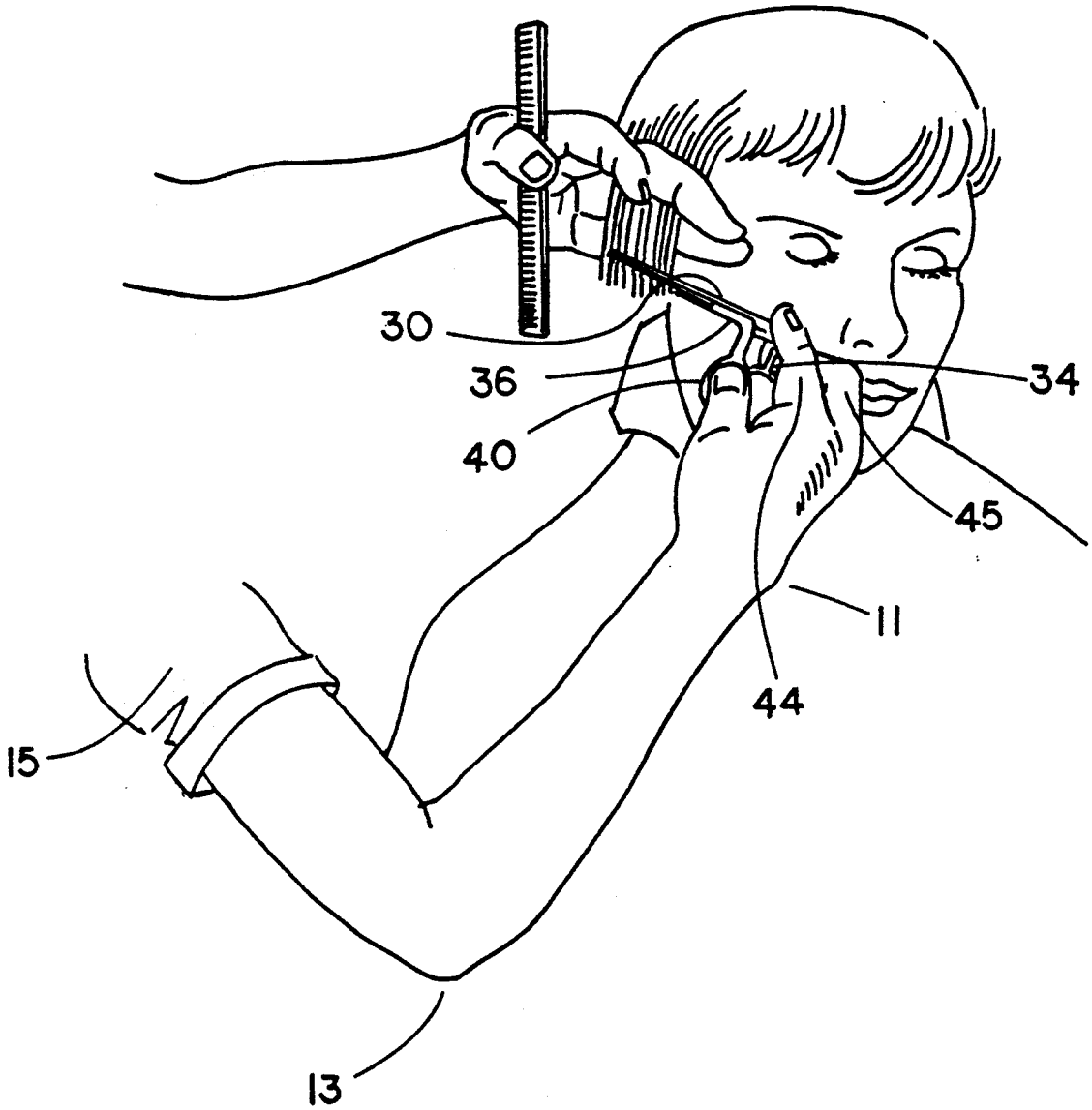
FIG. 5 is a pictorial view showing the ergonomic scissors of FIG. 3 in use cutting the hair on one side of the head of a client.
Figure 6:
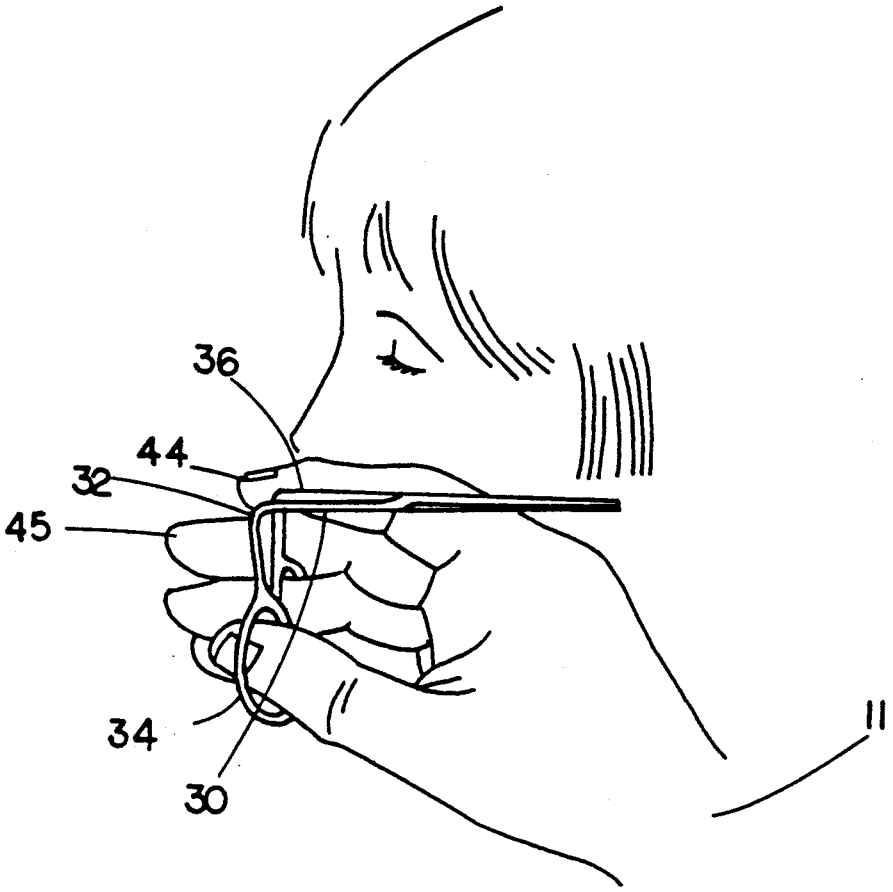
FIG. 6 is a pictorial view showing the ergonomic scissors of FIG. 3 being used to cut the hair on the opposite side of the head of a client.

Normally eyelet 40 receives the stylist's thumb, eyelet 34 receives the ring finger and stabilizing segment 30 is contacted by the index and middle fingers, as shown in FIG. 5, when the scissors are used to cut the hair on one side of the client's head with the tips of the thumb and ring finger pointing substantially in the same direction as the tips 41 and 43 of the scissors. However, as shown in FIG. 6, eyelet 34 receives the thumbs, eyelet 40 receives the ring finger, and stabilizing segment 36 is contacted by the index and middle fingers when the scissors are used to cut the hair on the other side of the client's head with the tips of the thumb and ring finger pointing in the direction substantially opposite to the tips 41 and 43 of the scissors.

The bends 32 and 38 in beams 25 and 29 are provided to enable the stylist to utilize the scissors to cut hair while substantially reducing the maximum dorsiflexion and palmarflexion of the stylist's wrist 42, thus reducing the likelihood of repetitive motion injuries such as carpal tunnel syndrome, tenosynovitis, and lateral epicondylitis. The reduction in shoulder abduction decreases tendonitis and bursitis of the shoulder. Furthermore, the likelihood of neck strain as well as thoracic outlet syndrome is substantially reduced.

In the preferred embodiment bends 32 and 38 are approximately 90° with respect to the plane of rotation of the first portions 25 and 29 of the beams. However it is believed that the risk of the injuries described above will be substantially reduced so long as the bends 32 and 38 are within the range of 60° to 120° from the plane of rotation.

Figure 7:
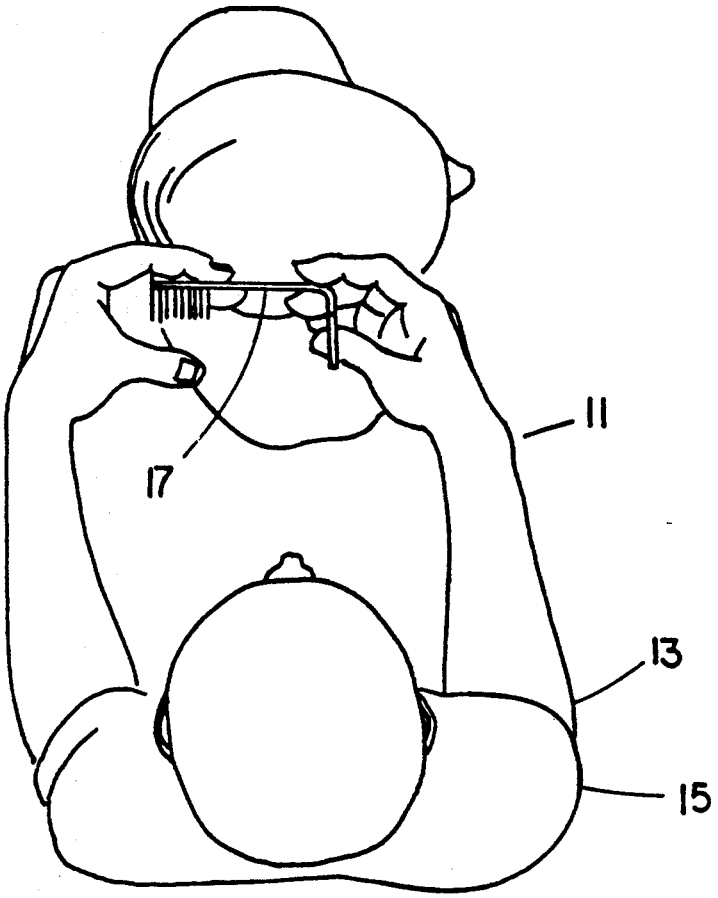
FIG. 7 is a top view of FIG. 5.

As shown in FIG. 5 the hair on the right side of the head of the client is being cut in a direction away from the face and toward the back of the head, in a direction away from the stylist. However when cutting the hair on the left side of the head as shown in FIG. 6, the scissors are reversed. That is, the thumb is place in loop 34 and the ring finger is placed in loop 40 and the scissors are moved from the front of the head toward the rear of the head. In both FIGS. 5 and 6, the scissors are stabilized by the use of index finger 44 and middle finger. 45. In the cutting position shown in FIG. 5, the index and middle fingers normally contact the side surface of stabilizing section 30 while in the cutting position shown in FIG. 6, the index and middle fingers normally contact the bottom and side surfaces of stabilizing section 36. Thus the bend in the scissors is provided without sacrificing a place where the index and middle fingers may be used to provide stabilization of the scissors for an accurate haircut. In both cutting positions shown in FIGS. 5 and 6 the stylist's wrist 11 is not severely dorsiflexed or palmarflexed and remains substantially straight and stable during the entire procedure. Furthermore, the elbow 13 is in a comfortable down position and the shoulder 15 is not abducted as shown in FIGS. 5 and 7.

Also it has been found that the client does not have to move his or her head nearly as much during the procedure with the use of the above-described scissors since the stylist is in a comfortable position and is not competing with the client for a more comfortable position, i.e. moving the client's head to decrease the positional strain on the stylist.

The above-described scissors may be operated by the stylist as follows. The stylist places his or her thumb through loop 40, places the ring finger through loop 34, and places his or her index finger on stabilizing segment 30 and begins cutting the hair on the left side of the head of the client, keeping the wrist 11 substantially straight. While standing to the side and somewhat to the front of the client, the client's head may remain in a comfortable straight position. After coming to approximately the center of the back of the head, the stylist then reverses the direction of the scissors and places the thumb through loop 34, the ring finger through loop 40 and the index and middle fingers on the bottom and side of stabilizing segment 30. The stylist then begins to cut the hair on the right side of the client's head, standing to the right side and slightly behind the client, cutting the hair toward the stylist, completing the cut at the middle of the back of the head. The remaining portions of the hair are cut, again by keeping the wrist 11 substantially straight and depending on what needs to be cut, in upward and/or downward direction.

A new and unique scissors is provided which substantially reduces the probability of cumulative trauma disorders for the stylist, provides more comfort for the client, and enables a more distributed cut in that the hair is cut in the same directions on both sides of the head. The scissors described above is easy and inexpensive to manufacture. The digit receiving portions should be at an angle between 60° and 120° out of the plane of rotation of the remainder of the scissors and preferably are 90° out of the plane of rotation.

From the foregoing description of the preferred embodiment of the invention, it is apparent that many modifications may be made therein without departing from the true spirit and scope thereof. It is intended in the appended claims to cover all such modifications.

What is claimed is:

1. A method for user to cut hair utilizing a scissors having first and second beams, each of said beams having a shearing edge and a handle, and including a pivot fulcrum means affixing said first and second beams together and permitting said beams to rotate with respect to one another with the pivot means located between said shearing edge and said handle of each of said beams, said handle including first and second portions, said first portion located nearer to said pivot means than said second portion, said second portion including means for securing at least one digit thereon and said means for securing being on a different plane from said first portion, said means for securing includes first and second loops, comprising the steps of:

placing a first digit through said first loop and placing a second digit through said second loop in one direction with respect to said loops when cutting hair on one side of the head;

cutting hair on one side of the head;

placing said first digit through said second loop and placing said second digit through said first loop in the opposite direction with respect to said loops when cutting hair on the other side of the head;

cutting hair on the other side of the head.

2. A method as set forth in claim 1 further including the step of:

placing a third digit of the hand in contact with said first portion thereby stabilizing said scissors.

3. A method as set forth in claim 2 further including the step of:

placing a fourth digit of the hand in contact with said first portion thereof further stabilizing said scissors.

4. A method as set forth in claim 2 further including the step of:

placing at least one digit of the other hand of the user in contact with said first portion thereby further stabilizing said scissors.

5. A method as set forth in claim 1 wherein said digits point in one direction with respect to said cutting edges when cutting the hair on one side of the head, and said digits point in the opposite direction with respect to said cutting edges when cutting the hair on the other side of the head.

* * * * *